US006310585B1

(12) United States Patent
Marino

(10) Patent No.: US 6,310,585 B1
(45) Date of Patent: Oct. 30, 2001

(54) ISOLATION IMPROVEMENT MECHANISM FOR DUAL POLARIZATION SCANNING ANTENNAS

(75) Inventor: Ronald A. Marino, Auburn Hills, MI (US)

(73) Assignee: Radio Frequency Systems, Inc., Marloboro, NJ (US)

( * ) Notice: Subject to any disclaimer, the term of this patent is extended or adjusted under 35 U.S.C. 154(b) by 0 days.

(21) Appl. No.: 09/408,178

(22) Filed: Sep. 29, 1999

(51) Int. Cl.[7] ..... H01Q 19/10

(52) U.S. Cl. ..... 343/818; 343/817; 343/833; 343/834; 343/839

(58) Field of Search ..... 343/818, 815, 343/817, 700 MS, 833, 834, 839, 757, 758, 759, 761, 763, 765, 766; 342/359

(56) References Cited

U.S. PATENT DOCUMENTS

| | | | | |
|---|---|---|---|---|
| 3,790,943 | | 2/1974 | Pickles et al. | 343/106 R |
| 3,882,503 | | 5/1975 | Gamara | 343/100 R |
| 3,978,484 | | 8/1976 | Collier | 343/754 |
| 5,063,389 | | 11/1991 | Reits | 342/359 |
| 5,294,939 | | 3/1994 | Sanford et al. | 343/836 |
| 5,485,167 | | 1/1996 | Wong et al. | 343/753 |
| 5,539,419 | | 7/1996 | Ogawa et al. | 343/761 |
| 5,872,547 | | 2/1999 | Martek | 343/815 |
| 5,896,107 | * | 10/1999 | Huynh | 343/700 MS |
| 5,917,455 | | 6/1999 | Huynh et al. | 343/792.5 |
| 5,952,983 | * | 9/1999 | Dearnley et al. | 343/817 |
| 5,969,690 | * | 10/1999 | Yamabayashi et al. | 343/792 |
| 6,028,563 | * | 2/2000 | Higgins | 343/797 |
| 6,049,310 | * | 4/2000 | Sadahiro | 343/702 |
| 6,069,586 | * | 5/2000 | Karlsson et al. | 343/700 MS |

FOREIGN PATENT DOCUMENTS

WO 98/34295 8/1998 (WO) .

* cited by examiner

*Primary Examiner*—Don Wong
*Assistant Examiner*—Tuyet T. Vo
(74) *Attorney, Agent, or Firm*—Sughrue, Mion, Zinn, Macpeak & Seas, PLLC

(57) ABSTRACT

An antenna arrangement is provide with a variable parasitic element whose position is varied as a function of the scan angle. According to an exemplary embodiment of the invention, a variable scanning array dual polarized antenna provides different scan angles by varying phase elements of the array. According to this embodiment an adjustable phase shift mechanism is used to modify the phase of the antenna array. The adjustable phase shift mechanism is used changes the antenna's phase as a function of a moveable dielectric slab. The dielectric slab slides over a microstrip line that results in a phase change that is a function of line coverage. A parasitic element is also connected to the dielectric slab such that the position of the parasitic element is varied in response to a change in the phase shift mechanism thereby varying the canceling signal of the parasitic element to optimize port isolation for the dual polarized antenna.

20 Claims, 6 Drawing Sheets

ISOLATION IMPROVEMENT MECHANISM FOR DUAL POLARIZATION SCANNING ANTENNAS

BACKGROUND

The present invention generally relates to radio communications and in particular to improved communication with scanning antennas.

Conventional communication systems for Cellular and Personal Communication Systems (PCSs) use a series of communications networks to allow users to communicate with one another. These networks include a number of Mobile Switching Centers (MSCs) that connect users to Private Switched Telephone Networks (PSTNs). In addition, the MSCs are connected to a number of base stations. The base stations are located in the various cells of the network in order to provide network coverage in the area that is local to the base station. The base stations are typically equipped with antennas that allow communication between the base stations and mobile users within the cell where the base station is located. The base stations in turn communicate with the MSCs and other base stations to allow PCS users to communicate with other PCS and PSTN users.

Conventionally, dual polarized phased array antennas are used to transmit and receive RF communications at the base station. These antennas are commonly located on the top of towers and service communication within a cell or micro cell. A phased array is an antenna having two or more driven elements directly connected to a feed line which is in turn connected to a feed network. Conventionally a plurality of driven elements are used for antennas adapted for use in cellular communications at towers connected with the base stations. The driven elements are fed with a particular relative phase and are spaced at a predetermined distance from each other. This arrangement results in a directivity pattern exhibiting gain in some directions and little or no radiation in others.

In order to provide polarization diversity, orthogonal polarization is commonly used to provide non-correlated paths. The direction of polarization is commonly measured from a fixed axis and can vary as required by system specifications. The polarization direction can extend from vertical polarization (e.g., zero degrees) to horizontal polarization (e.g., 90 degrees). Most conventional systems use slant polarization of ±45 degrees to −45 degrees in order to isolate communications between one of two communication ports. If the antenna receives or transmits signals of two polarizations that are normally orthogonal, they are referred to as dual polarized antennas. Dual polarized antennas are required to meet specified port-to-port coupling or isolation requirements between dual ports that are connected to the feeder network. Conventionally, port-to-port isolation is required to be −30 db.

It is therefore desirable to have very low port isolation. One method of improving port-to-port isolation of dual polarized antennas is to fix parasitic elements in phased array fixed beam antennas. The parasitic element is an electrical conductor or circuit that is not directly connected the feed line (or communications ports) of the antenna. The parasitic element is used to perturb the electromagnetic field in such a way that port isolation i s increased. This is not to be confused with parasitic elements used in Yagi antennas that are used to provide directivity and power gain and operate by EM coupling to the driven antenna elements. For example, these parasitic elements placed parallel to the driven elements, at a predetermined distance and having a predetermined length, but not connected to anything, cause a radiation pattern to show gain in one direction and loss in the opposite direction. When a gain is produced in the direction of the parasitic element, the parasitic element is a director. When the gain is produced in the direction opposite of the parasitic element, the parasitic element is known as a reflector and provides a canceling signal.

In marked contrast, parasitic elements as used in the present invention, have been used to improve port-to-port isolation in dual polarized fixed beam antennas. The parasitic element is carefully placed on the antenna at a spot that is empirically determined to reduce the isolation between ports of the feed network to the antenna. The parasitic element is then fixed in place at the position that is determined to provide the best port-to-port isolation.

Although it is desirable to improve port-to-port isolation, many cellular/PCS communication systems use a scanning antenna array arrangement of dual polarized antennas. Scanning antenna arrays may be adjusted by repositioning the arrays to avoid channel interference with other broadcast stations and their associated antennas caused by overcrowding and to optimize coverage within a specific area serviced by the antenna. An example of a scanning antenna is a down tilt antenna. Down tilt antennas help reduce the problem of cell site overlap by adjusting the vertical scan angle to carefully position the antenna in order to provide the necessary coverage while avoiding interference with other microcells within the network and adjacent competing networks.

Conventionally, while fixed parasitic elements are used to establish low port-to-port isolation for dual polarized antennas in fixed beam antennas, the improvement is not evident in scanning beam antennas, such as downtilt antennas because the improved isolation is not uniform over the full scan range of the downtilt, for example. In fact, the isolation is actually degraded for certain angles by destructively adding to the isolation response or by changing the mutual coupling between ports in such a way that reduces the quality of the overall isolation response. As the isolation response changes as a function of the tilt angle and therefore conventional mechanisms providing a fixed canceling response will not work effectively to reduce the isolation response over a varying scan angle. Therefore, parasitic elements are not used to improve isolation response in scanning antennas.

SUMMARY

It is therefore an object of the invention to provide improved port isolation for antenna arrays.

It is another object of the invention to provide an improved isolation response for scanning antennas.

It is a further object of the invention to provide improved low port-to-port isolation in a dual phase antennas arrays over a range of scan angles.

According to an exemplary embodiment of the present invention, the foregoing and other objects are accomplished through implementation of a variable parasitic element whose position is varied as a function of the scan angle.

According to an exemplary embodiment of the invention, a variable electric downtilt antenna is used. A downtilt antenna provides different scan angles or downtilt by varying the phase elements of the antenna array. According to this exemplary embodiment an adjustable phase shift mechanism is used to modify the phase of the antenna array. The adjustable phase shift mechanism changes the antenna's phase as a function of a moveable dielectric slab that is controlled in response to signals sent to a phase controller. The dielectric slab slides over a microstrip line that results in a phase change that is a function of line coverage. A parasitic element is also coupled to the phase shift mechanism such that the position of the parasitic element is varied in response to a change in the phase shift mechanism. As a result, as the isolation response changes over the range of the tilt angles a varying canceling response is provided that can reduce the isolation response over varying scan angles. Therefore, parasitic elements according to the present invention can be used to improve isolation response in scanning antennas.

BRIEF DESCRIPTION OF THE DRAWINGS

The foregoing and other features, objects, and advantages of the invention will be better understood by reading the following description in conjunction with the drawings, in which.

DETAILED DESCRIPTION

Figure 1:
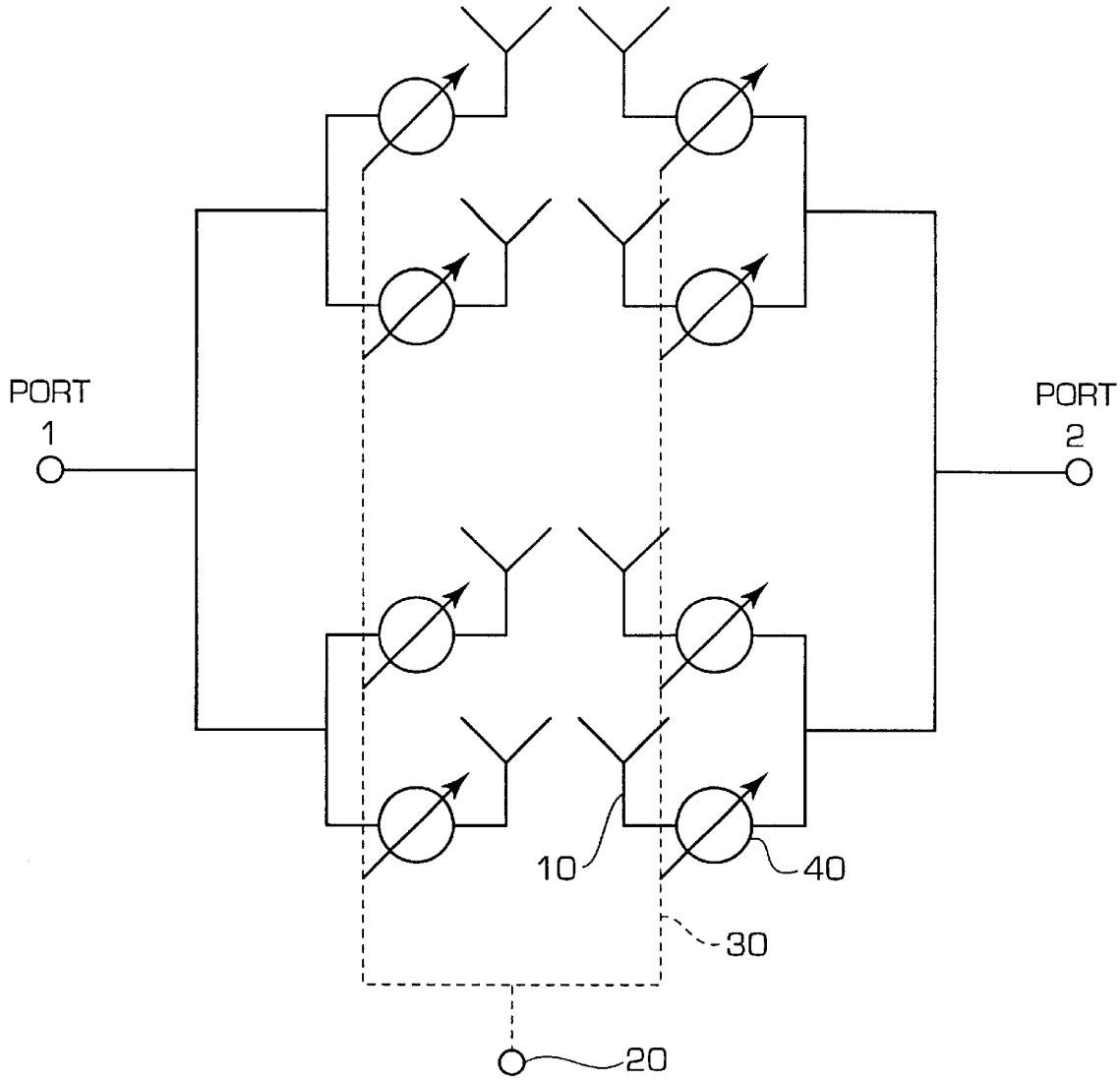
FIG. 1 shows a block diagram of an exemplary dual phased array antenna.

The various features of the invention will now be described with respect to the figures, in which like parts are identified with the same reference characters.

A dual polarization phased array scanning antenna for use in the present invention, as shown in FIG. 1, for example, contains a number of dual polarized antennas 10 forming a downtilt antenna array. Although the exemplary embodiments described herein refer to a down tilt antenna, one skilled in the art will appreciate that other types of antennas that change position or scan can be used without departing from the scope of the invention. In addition, one skilled in the art will also appreciate that the number of antennas in the array are purely exemplary and that other numbers of antennas are also contemplated as being used according to the present invention.

According to the exemplary embodiment shown in FIG. 1, two communications ports 1 and 2 are to connect the antennas by a feeder network. Energy is fed to and received from the ports 1 and 2 during communications using the antenna array. In addition, a number of variable phase shift mechanisms 40 are connected to the antennas 10 in order to vary the phase of the antennas and thereby adjust the downtilt or scanning angle of the antennas 10 in the antenna array. The variable phase shift mechanisms 40 may be mechanically or electrically controlled. Each of the phase shift mechanisms comprises a series of gears that cause the antenna to move and thereby adjust the phase of the antenna. For example a sliding dielectric may be used. A gear is also provided having an indication of the position of the antenna. A single gear assembly which adjusts the radiation beam to a specified down tilt can be used to position both the phase shifter and parasitic element. The gear assembly according to one exemplary embodiment is explained in greater detail below with regard to FIGS. 3–5.

A phase shift controller 20 is connected to the phase shift mechanisms 40 to allow a user to set or changed the downtilt of the antennas 10 in the antenna array. In this way, a user may adjust the downtilt of the antenna to optimize the antenna's coverage when it is installed in the communication network or to change its coverage in response to changing network conditions. The controller 20 slides a piece of dielectric over the microstrip line using a positioning mechanism 30 causing the phase adjusters 40 to vary the scan angle of their associated antenna 10.

Figure 2:
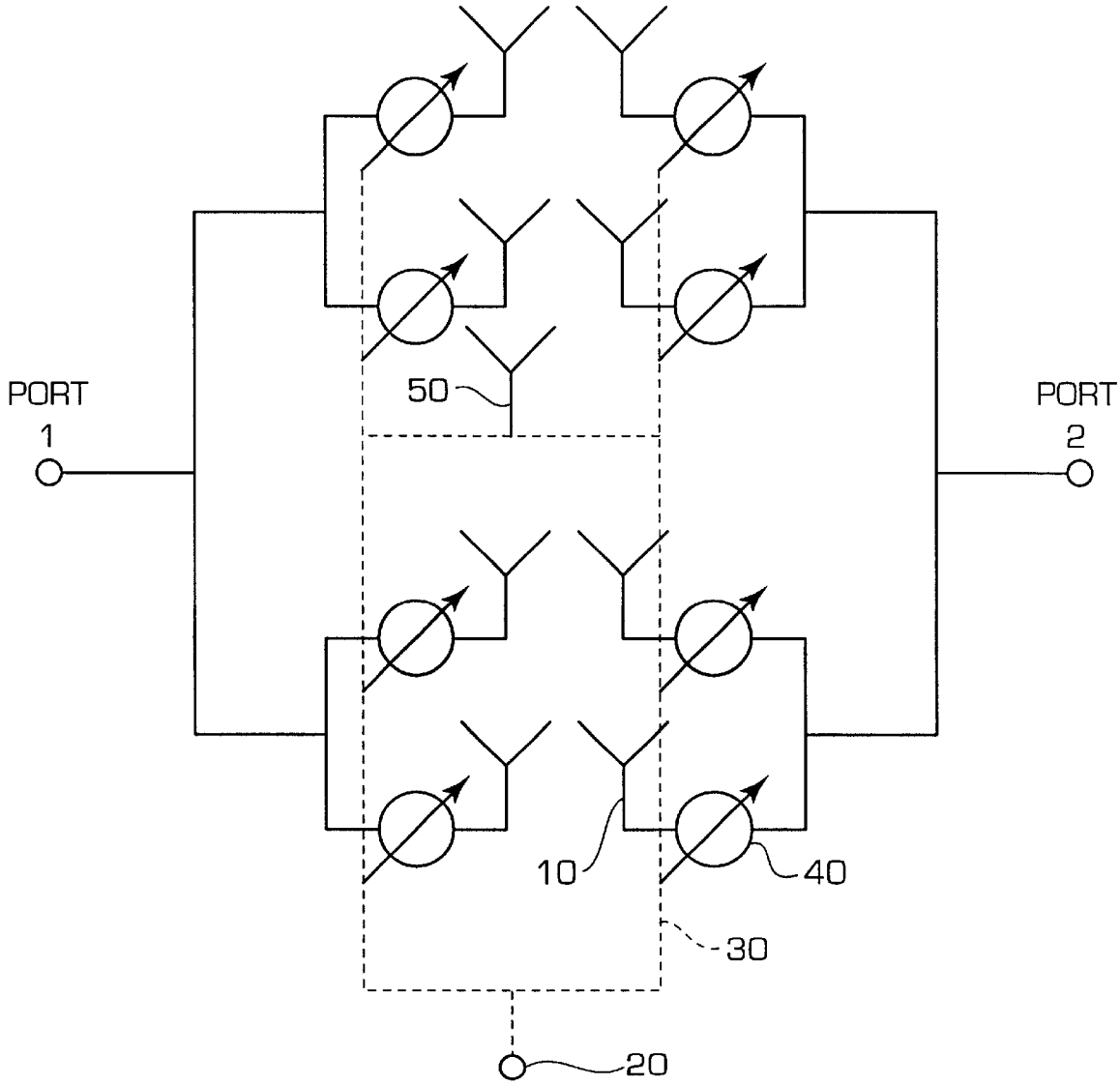
FIG. 2 shows a block diagram of a dual phased array antenna according to an exemplary embodiment of the invention.

As previously described, the isolation response of the antennas changes as a function of the scan angle of the antenna array. Turning to FIG. 2, a downtilt antenna according to an exemplary embodiment of the invention is shown. As shown in the exemplary embodiment of FIG. 2, a parasitic element 50 has been added. Although only a single parasitic element is used, one skilled in the art will appreciate that any number of such elements may be incorporated. The parasitic element 50 is a conductive element that is EM coupled to the driven antennas 10. The parasitic element 50 is also connected to the phase shift mechanism. As the phase shift mechanism moves the dielectric element to shift the phase of the antenna elements in response to adjustments made by the system controller, a corresponding change in position of the parasitic element 50 is also made. As a result, a canceling signal generated by the parasitic element is varied with a corresponding change in the scan angle of the antennas 10. The resultant canceling signal is of substantially equal amplitude and substantially 180° out of phase with the isolation vector thereby resulting in cancellation or a significant reduction.

The change in position of the parasitic element 50 is designed to provide the correct canceling signal to that of the varying isolation response. This is accomplished by moving the parasitic element 50 and measuring the isolation response for different scan angles. The position of the parasitic element 50 establishing the lowest isolation response is then chosen for each scan angle. Measurement of the port isolation can be determined by placing the parasitic element and injecting a signal into one of the ports and measuring if any signal is produced on the other port.

According to one exemplary embodiment the parasitic element is designed to be invisible at high down tilt scan angles. Since the parasitic element may have less affect on the isolation response at high downtilt angles, the parasitic element 50 can be placed in a position that minimizes its affect on the isolation response for these angles. In turn, this allows design of the parasitic element 50 to be optimized for scan angles that approach the horizon where the parasitic element has a much greater affect on the isolation response.

Figure 3:
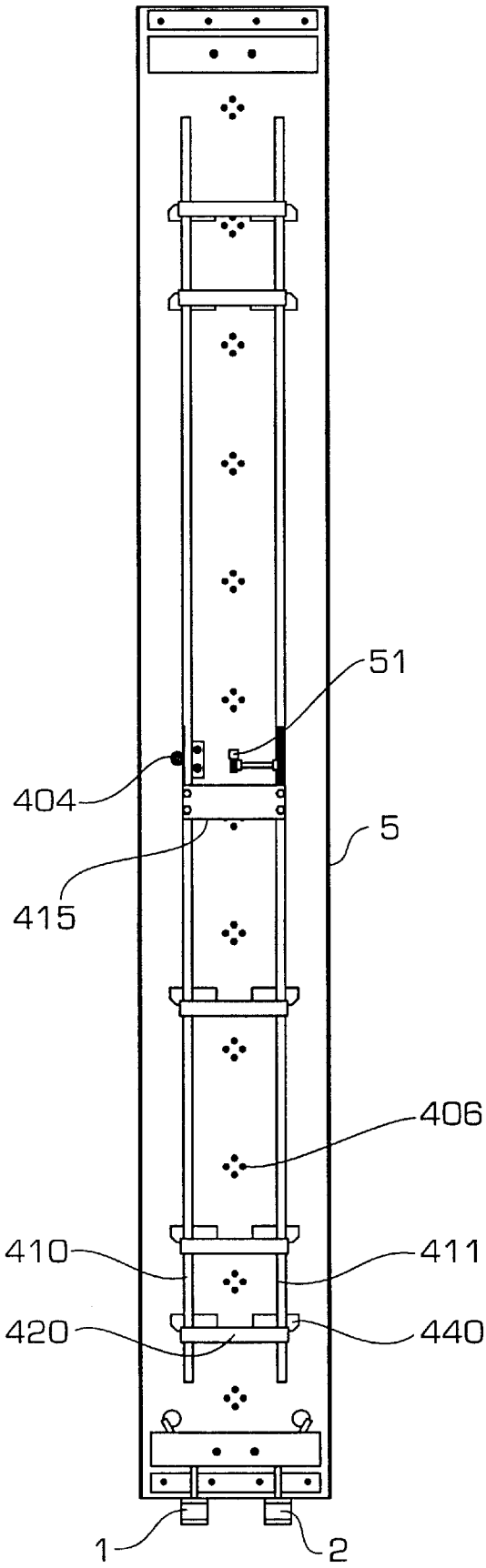
FIG. 3 shows an exemplary dual phased array antenna assembly including a mechanism for moving the parasitic element according to an exemplary embodiment of the invention.

Turning to FIG. 3 an exemplary mechanism for coupling the parasitic element and phase controller is shown in more detail. After the positioning of the parasitic element 50 is optimized through measurements of the array, a mechanism is attached to the microstrips 30 to move the parasitic element to the pre-established positions based on the movement of the gears for the phase shifters 40.

FIG. 3 shows an exemplary antenna assembly is shown according to one embodiment of the invention. A reflector 5 is provided with input ports 1 and 2. Twelve sets of screw holes 406 are also shown for securing the antenna elements (not shown) on the opposite side of the reflector.

Also mounted on the reflector 5 is the phase shift mechanism. Two rods 410 and 411 are mounted on the reflector 5. The rods 410 and 411 are connected to phase shifters 440 that are place in contact with a microstrip line/circuit board 480 (shown in FIG. 4). The rods are secured together with a central support 415 that allows the rods 410 and 411 to move in unison. Five locators 420 help to stabilize the rods 410 and 411. In addition, the locators 420 are flexible and apply pressure to the phase shifters 440 placed below the locators 420 allowing the phase shifters to remain in close proximate contact with the microstrip 480 and slide thereon. A gear 404 is provided that allows an operator to adjust the position of the rods 410 and 411 and thereby adjust the position of the phases shifters. As the position of the rods 410 and 411 is adjusted, the locators 430 are repositioned which in turn adjusts the phase shifters 440 and thereby adjusts the radiation beam or downtilt scan angle of the antenna elements.

Figure 4:
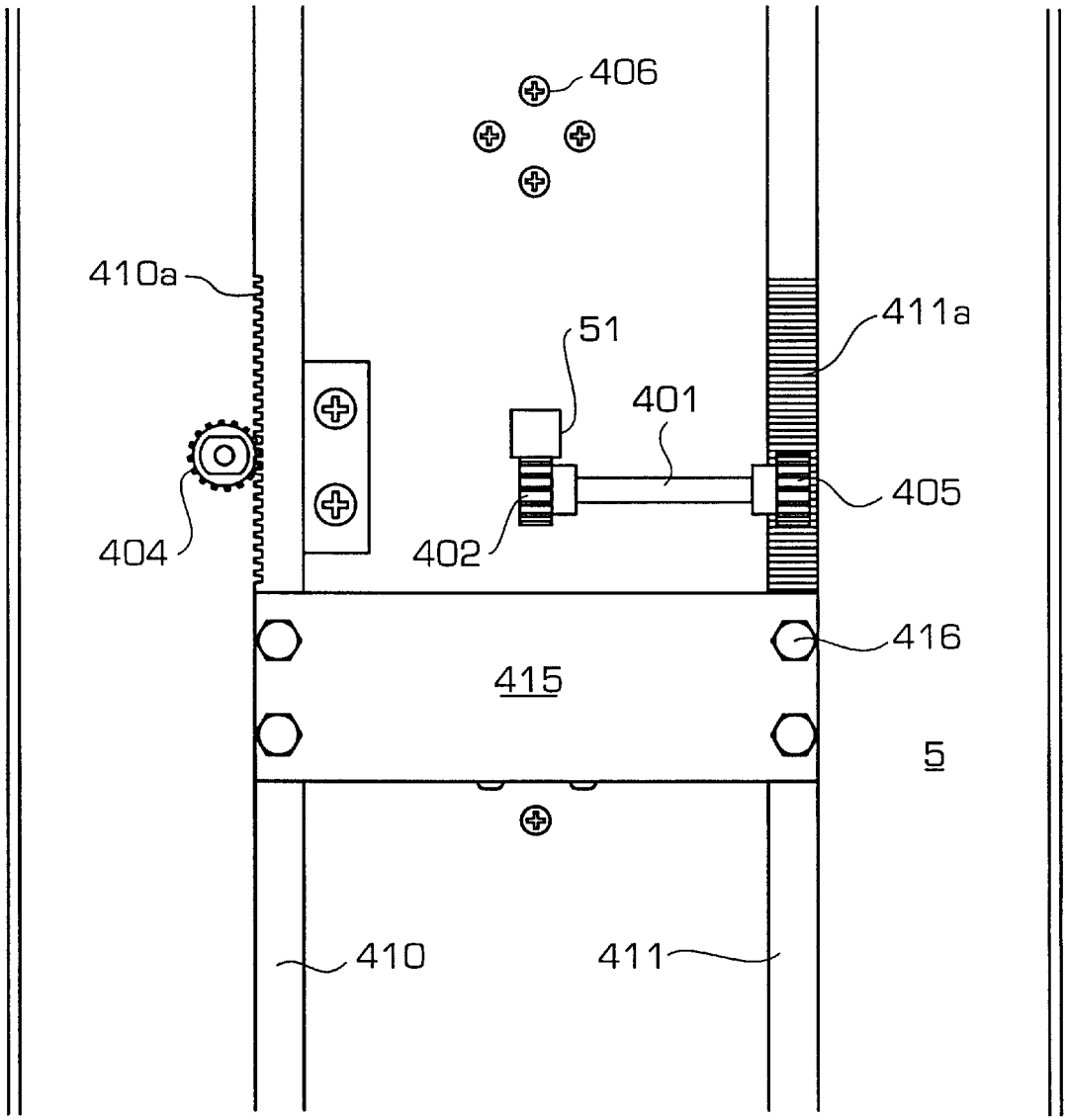
FIG. 4 is an enlarged a top view of FIG. 3 showing an exemplary mechanism for moving a parasitic element.

FIG. 3 also shows a shaft 51 that is attached to the parasitic element 50 and adjustment mechanism. Turning to FIG. 4, the area around the parasitic element 50 is shown in an enlarged view of FIG. 3. As shown in FIG. 4, one of the rods 410 has teeth 410*a* on the outside edge thereof that interconnect with gear 404. As the gear 404 is turned the position of the rod 410 is correspondingly changed. The structure 415 is attached to both rods 410 and 411 via screw 416 and insures that rods move in unison.

Figure 5:
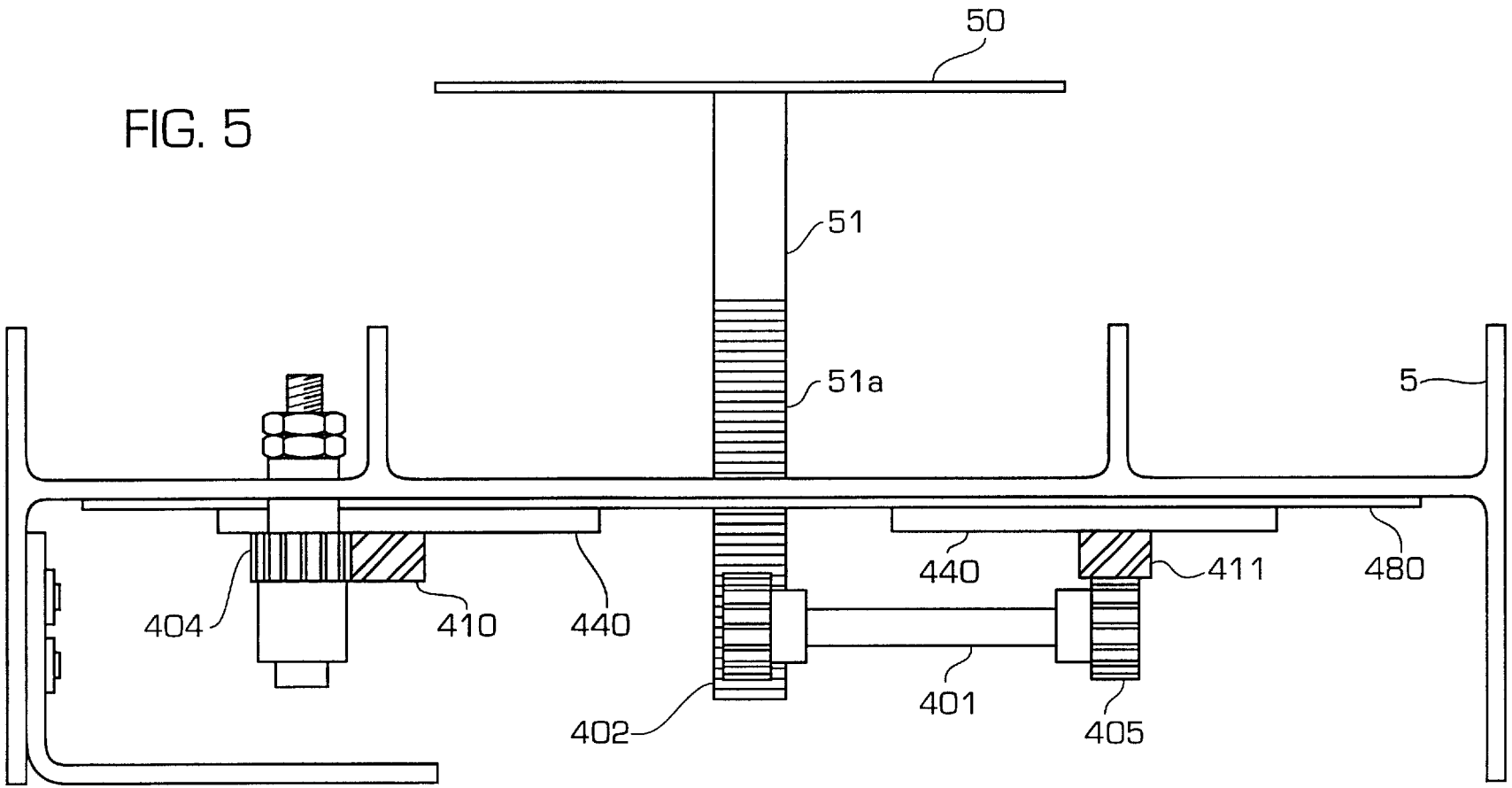
FIG. 5 is an enlarged side view of the exemplary mechanism for moving a parasitic element shown in FIG. 4.

Rod 411 has teeth 411 on the top thereof which mate with gear 405. As the rods 410 and 411 move the position the phase shifters 440, the gear 405 turns gear 402 via axle 401 to move the parasitic element 50. Turning to FIG. 5 a cut away, planar view of the enlarged view of FIG. 4 is shown. As rod 411 moves, the teeth 411*a* mate with and turn gear 405. Gear 405 via axle 401 turns gear 402. Gear 402 mates with teeth 501*a* on a vertical shaft 501 supporting the parasitic element 50. As the phase shifters 440 are positioned to adjust the downtilt of the antenna, a corresponding shift in position is applied to the parasitic element 50. When the scan angle of the antenna is close to the horizon the parasitic element 50 is placed at a position relative to reflector 5 that is in close proximity to the dipoles. For example, the parasitic element could be placed between the dipoles. As the antenna scans down, or the downtilt of the antenna is increased, the parasitic element 50 is moved and according to one embodiment can be placed away from said dipoles. As a result the position of the parasitic element can be optimized for each scan angle.

Figure 6:
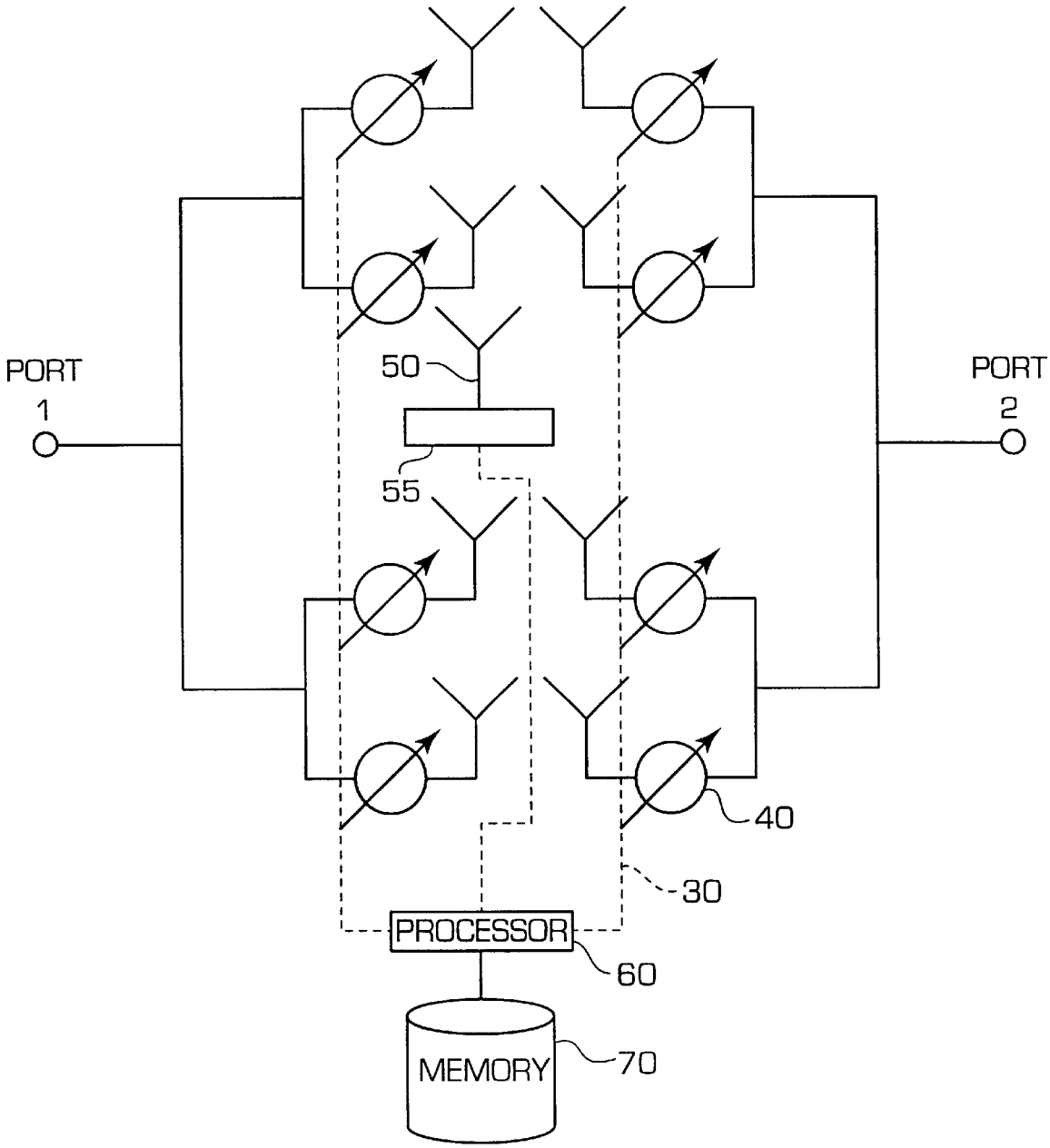
FIG. 6 is an exemplary block diagram of an alternative embodiment of the invention.

Although a mechanical mechanism has been shown, according to an exemplary embodiment, for moving the parasitic element 50 and phase shifters 40, an electromechanical assembly could also be used wherein a stepper motor would electrically move the gears to position the phase shifters and parasitic element. In addition, the position of the gears could be store in a memory in digital form. According to this exemplary embodiment, as shown in FIG. 6, the position of the parasitic element 50 could be adjusted based on a position of the phase shifter and controlled by a processor 60. A processor 60 would communicate with the phase shifter or sensors (not shown) to read the positions of the phase shifters and store them in a memory 70. One skilled in the art would appreciated that a DSP, microprocessor, or ASIC could be used as the processor 60. The processor 60, could then be used to determine a corresponding position of the parasitic element 50 based on the position of the phase shifters 40 and adjust the position of the parasitic element 50 accordingly via an adjustment mechanism 55.

The present invention has been described by way of example, and modifications and variations of the exemplary embodiments will suggest themselves to skilled artisans in this field without departing from the spirit of the invention. For example, although the invention has been described in relation to a single parasitic element one skilled in the art would appreciate that a plurality of parasitic elements could also be implemented according to the present invention.

The preferred embodiments are merely illustrative and should not be considered restrictive in any way. The scope of the invention is to be measured by the appended claims, rather than the preceding description, and all variations and equivalents that fall within the range of the claims are intended to be embraced therein.

What is claimed is:

1. A communication system comprising:

a first communication port;

a second communication port;

a first antenna connected to said first communication port;

a second antenna connected to said second communication port;

a parasitic element; and a controller connected to said first and second antennas and said parasitic element, wherein the controller varies the position of said first and second antennas and said parasitic element such that port-to-port isolation of said first and second communication ports is optimized as a function of the position of a scan angle of said first and second antennas in relation to the position of said parasitic element.

2. The system of claim 1 wherein said antennas are dual polarized antennas.

3. The system of claim 1, wherein as the scan angle approaches the horizon the parasitic element is placed in close proximity to dipoles of the first and second antennas.

4. The system of claim 1, further comprising a memory connected to the controller for storing a plurality of predetermined positions of said first and second antennas and said parasitic element wherein port-to-port isolation of said first and second communications ports is optimized.

5. The system of claim 1, wherein said parasitic element comprises a conductive element which is EM coupled to said first and second antennas.

6. The system of claim 1 further comprising first and second phase shifters to vary the phase of the first and second antennas thereby adjusting the scan angle of the antennas.

7. The system of claim 6, wherein said first and second phase shifters comprises a gear mechanism for moving the first and second antennas to adjust the scan angle of the antennas.

8. The system of claim 7, wherein said first and second phase shifters comprises a dielectric member and a microstrip line, and said controller slides said dielectric member over the microstrip line to vary the scan angle of the first and second antennas.

9. A communication system comprising:

a first communication port;

a second communication port;

a first plurality of antennas connected to said first communication port;

a second plurality of antennas connected to said second communication port;

a parasitic element; and a controller connected to said first and second plurality of antennas and said parasitic element, wherein the controller varies the position of said antennas and said parasitic element such that port-to-port isolation of said first and second communication ports is optimized as a function of the position of a scan angle of said first and second plurality of antennas in relation to the position of said parasitic element.

10. The system of claim 9 wherein said first and second plurality of antennas are dual polarized antennas.

11. The system of claim 9, further comprising a memory connected to the controller for storing a plurality of predetermined positions of said first and second antennas and said parasitic element wherein port-to-port isolation of said first and second communications ports is optimized.

12. The system of claim 9, wherein said parasitic element comprises a conductive element which is EM coupled to said first and second antennas.

13. An antenna arrangement comprising:

an adjustable parasitic element;

an adjustable antenna element; and a mechanism coupling said parasitic element and said antenna element, wherein said mechanism varies the positions of said adjustable antenna element and said parasitic element such that the position of the parasitic element is automatically varied based on changes in the position of the antenna element.

14. The antenna arrangement of claim 13, wherein said mechanism comprises a gear assembly for moving said parasitic element based on the position of said antenna element to adjust the downtilt of the antenna element.

15. The antenna arrangement of claim 13, wherein said mechanism comprises:

a gear assembly connected to said antenna element and said parasitic element;

a stepper motor connected to said gear assembly;

a memory for storing plurality of predetermined positions of said antenna element and said parasitic element wherein port-to-port isolation of said first and second communications ports is optimized; and a processor connected to said memory and said stepper motor, said processor for controlling said stepper motor to adjust the position of said parasitic element based on said plurality of predetermined positions of said antenna element and said parasitic element stored in said memory.

16. An antenna arrangement comprising:

an adjustable parasitic element providing a canceling signal;

an adjustable antenna element; and a mechanism coupling said parasitic element and said antenna element, wherein said mechanism varies the positions of said adjustable parasitic element and said adjustable antenna element such that said canceling signal is automatically varied based on changes in the position of the antenna element.

17. The antenna arrangement of claim 16 wherein said canceling signal is varied as a function of a scan angle of said antenna element.

18. The antenna arrangement of claim 16, wherein said mechanism comprises a gear assembly for moving the antenna element to adjust the downtilt of the antenna element and moving the parasitic element to vary the position of the parasitic element based on the position of the antenna element.

19. A dual polarized two port antenna comprising:

two communication ports;

a feed line connected to each communications port;

an antenna beam connected to said ports that may be scanned;

an adjustable parasitic element providing a canceling signal; and a mechanism coupling said parasitic element and said antenna beam, wherein, said mechanism automatically varies the position of the parasitic element based on the position of the antenna beam.

20. A method of isolating communication ports in a communication comprising first and second communication ports, a first antenna connected to said first communication port, a second antenna connected to said second communication port, and a parasitic element, the method comprising automatically moving said parasitic element when the position of said first and second antennas is changed such that port-to-port isolation of said first and second communication ports is optimized as a function of the position of a scan angle of said first and second antennas in relation to the position of said parasitic element.

* * * * *